United States Patent [19]

Rabren

[11] Patent Number: 4,800,930

[45] Date of Patent: Jan. 31, 1989

[54] SOLVENT FOR POROUS MASS ACETYLENE CONTAINERS

[76] Inventor: Michael S. Rabren, 101 Mason Dr., Citronelle, Ala. 36522

[21] Appl. No.: 29,628

[22] Filed: Mar. 24, 1987

[51] Int. Cl.[4] ..... B65B 31/00

[52] U.S. Cl. ..... 141/9; 141/4; 141/100

[58] Field of Search ..... 141/1–12, 141/37–66, 100–310, 234–248

[56] References Cited

U.S. PATENT DOCUMENTS

| | | | |
|---|---|---|---|
| 2,849,396 | 8/1958 | Nelson | 252/1 |
| 2,925,385 | 2/1960 | Winnacker et al. | 252/1 |
| 4,010,777 | 3/1977 | Mogensen | 141/4 |
| 4,129,450 | 12/1978 | Flanigen et al. | 106/120 |
| 4,153,083 | 5/1979 | Imler et al. | 141/4 |
| 4,483,461 | 11/1984 | Igarashi | 222/3 |
| 4,582,100 | 4/1986 | Poulsen | 141/4 |

*Primary Examiner*—Henry J. Recla
*Assistant Examiner*—Ernest G. Cusick
*Attorney, Agent, or Firm*—Woodcock Washburn Kurtz Mackiewicz & Norris

[57] ABSTRACT

Disclosed are improved methods and apparatus for filling acetylene gas cylinders. In particular, acetylene containers having a porous mass contained therein and a solvent occupying a portion of the pores of the porous mass are disclosed. The solvents comprise acetone and an amount sufficient to improve the acetylene storage capacity of the solvent of a lower alkyl alcohol. Solvents containing acetone and methanol are disclosed as being particularly preferred.

10 Claims, 1 Drawing Sheet

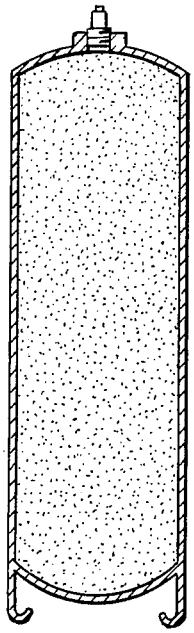

SOLVENT FOR POROUS MASS ACETYLENE CONTAINERS

BACKGROUND OF THE INVENTION

The present invention relates to improved methods and apparatus for filling acetylene gas cylinders. More particularly, the present invention relates to improved solvents for use in porous mass acetylene cylinders.

Acetylene gas is widely used in industry, primarily for cutting, welding of steel members and as a heat treatment fuel. As is well known, however, acetylene gas is relatively unstable at high pressure and cannot be transported safely in open chambered cylinders of the type used to transport most other industrial gases. Due to this instability, acetylene is generally used and sold as "dissolved acetylene". That is, acetylene is normally transported in elongated steel cylinders of a specialized type, each cylinder containing a porous "body" or "mass" within which an acetylene solvent is absorbed. The porous mass normally fills the entire cylinder body, and typically comprises a porous, monolithic substance such as calcium medisilicate having an admixture of suitable fibrous material, for example asbestos, to increase its mechanical strength. In order to stabilize the acetylene to be added, the porous mass is charged or filled with a solvent. In typical prior art applications, the solvent was acetone or dimethylformamide (DMF).

While such a solvent charged porous mass enables the container to store a greater quantity of acetylene than can be otherwise safely stored, it is clear that the desirability of any one solvent over another is a function of the safety, cost and capacity of each individual solvent. Accordingly, a low cost, high capacity solvent with undiminished safety characteristics is highly desirable.

Due to the use of solvent charged porous mass cylinders, filling of acetylene cylinders involves an additional problem which is not normally encountered in the filling of cylinders with gases other than acetylene. When the acetylene gas is removed from the cylinder by the user, a certain amount of the solvent can escape along with the acetylene. As a result, the quantity of solvent remaining in a returned cylinder is generally always less than the initial charge. This, in turn, results in an additional cost associated with supplying acetylene in this manner since the cost of make-up solvent will ultimately be charged to the user.

SUMMARY OF THE INVENTION

One object of the present invention is to provide acetylene solvents for porous mass cylinders which are safe and which comply with federal D.O.T. regulations.

Another object of the present invention is to provide acetylene solvents for porous mass cylinders which are relatively inexpensive.

It is a still further object of the present invention to provide acetylene solvents for porous mass cylinders which are safe and relatively inexpensive, and which have a relatively high capacity for storing acetylene.

Another object of the present invention is to provide acetylene solvents for porous mass cylinders which have a strong tendency to remain within the cylinders upon acetylene removal.

Another object of the present invention is to provide methods for efficiently and safely storing relatively large quantities of acetylene gas at low cost.

One embodiment of the present invention provides a container having a porous mass contained therein and a solvent occupying at least a portion of the porous space of said porous mass, said solvent comprising acetone and an amount sufficient to improve the acetylene storage capacity of the solvent of a lower alkyl alcohol.

Another embodiment of the present invention provides a method for storing acetylene in closed containers. this method, containers having a porous mass contained therein are provided. The method then requires adding a solvent to the container, said solvent comprising acetone and an amount sufficient to improve acetylene storage capacity of the solvent of a lower alkyl alcohol. Acetylene is then added to the containers whereby improved acetylene storage capacity is attained.

BRIEF DESCRIPTION OF THE DRAWING

The drawing is a longitudinal sectional view of a porous mass filled acetylene cylinder in which the porous mass is indicated by stippling.

DESCRIPTION OF THE PREFERRED EMBODIMENT

Applicant has found that a methanol charged porous mass will safely and relatively efficiently contain dissolved acetylene in pressurized cylinders. An example of a conventional dissolved acetylene cylinder is shown in the drawing. Referring now to the drawing, a porous material 2 consisting of, for example, mainly calcium silicate is provided in a cylinder 1. The container includes a valve 3 for allowing the introduction and expulsion of gases. More particularly, applicant has found that methanol is readily absorbed into the micro pores of the porous mass, particularly into the micro pores of calcium medisilicate porous masses. Applicant has also found that such absorbed methanol readily solvates substantial quantities of pressurized acetylene gas. Moreover, methanol appears to have a strong tendency to remain within the porous mass when the pressurized acetylene is removed. These characteristics, coupled with the cost advantage of methanol relative to many of the heretofore used solvents, make methanol an attractive and viable solvent for use in porous mass filled acetylene cylinders. For example, the cost of methanol has historically been approximately only one third the cost of acetone on a volume basis. Accordingly, the use of methanol in place of the heretofore used solvents provides significant savings in solvent cost.

While applicant does not intend to be bound by or to any particular theory, applicant believes that the use of lower alkyl alcohols in general will be effective and safe solvents for porous mass acetylene cylinders. More particularly, applicant believes that ethanol and propanol are also effective solvents for porous mass cylinders.

Despite the advantages described above, it has been discovered that the ability of essentially pure methanol to dissolve acetylene in a porous mass is somewhat less than that of pure acetone, as described more fully below. Accordingly, while lower alkyl alcohols in general and pure methanol in specific are preferred over acetone on a cost basis, they may be less desirable on a capacity basis. Surprisingly and beneficially, however applicant has discovered that when mixtures of a lower alkyl alcohol, and particularly methanol, and acetone are used as solvents for porous mass cylinders, the capacity of the mixtures to dissolve acetylene is greater than either methanol or acetone alone. This surprising result is beneficial in that such mixtures provide solvents which have a high capacity and a low cost relative to heretofore used solvents. Moreover, such mixtures provide solvents which are safe for use in a porous mass environment and which have a strong tendency to remain within the porous mass. Thus, applicant has found that acetylene solvents which comprise acetone and methanol have beneficial characteristics when used as an acetylene solvent in porous mass cylinders. For example, porous mass filled acetylene cylinders containing such solvents have a low cost relative to the use of pure acetone alone due to the cost differential between methanol and acetone. In addition, acetylene cylinders containing such solvents also have a higher capacity to store acetylene than cylinders using acetone alone as a solvent. Such capacity increases prolong, for example, the welding capacity of the cylinder and are thus very desirable to the user. The strong tendency of the solvents of the present invention to remain within the porous mass when the acetylene is removed from the cylinder is also desirable and beneficial. That is, the reduced need for solvent make-up upon refilling reduces the supplier's cost of providing filled acetylene cylinders. Solvents according to the present invention preferably contain more than trace amounts of methanol, preferably up to about 20% methanol on a volume basis, and even more preferably up to about 10% methanol on a volume basis. According to one preferred embodiment, solvents of the present invention comprise about 80% acetone and up to about 20% methanol on a volume basis. According to another preferred embodiment of the present invention, solvents comprise about 90% acetone and up to about 10% methanol on a volume basis.

Several non-limiting examples which illustrate certain aspects of the present invention are provided below.

COMPARATIVE EXAMPLE 1

100% Acetone

Conventional calcium silicate porous mass acetylene cylinders each having a nominal capacity of about 130 standard cubic feet (SCF) were provided. These cylinders were provided with an initial solvent charge of essentially pure acetone according to industry standards. The cylinders were then attached to an acetylene filling manifold and filled with acetylene according to industry standard procedures.

Using a solvent consisting essentially of pure acetone as described above, an average of 121.5 SCF of acetylene were safely stored in each container according to compliance procedures for acetylene cylinder design approval. More particularly, the cylinders passed a test conducted in accordance with the Compressed Gas Cylinders Association Pamphlet ("CGCA") C-12 guidelines as referred to in U.S. Code 49 of Federal Regulations entitled "Qualification Procedure for Acetylene Cylinder Design".

On average, each cylinder had an acetylene capacity of about 0.52 pounds of acetylene per pound of acetone.

EXAMPLE 2

100% methanol

Conventional calcium silicate porous mass acetylene cylinders each having a nominal capacity of about 130 SCF were provided. The cylinders were charged with essentially pure methanol according to industry standard procedures. The cylinders were then attached to the acetylene filling manifold and filled with acetylene at the same time and under the same conditions as in comparative Example 1. On average, 80 SCF of acetylene are safely dispensed to each container to bring the containers to the full state in compliance with CGCA Pamphlet C-12 guidelines.

On average, each cylinder had an acetylene capacity of about 0.35 pounds of acetylene per pound of methanol.

EXAMPLE 3

90% acetone/10% methanol

A total of 10 conventional calcium silicate porous mass acetylene cylinders each having a nominal capacity of about 130 SCF were provided. Each cylinder was provided with an initial charge of solvent comprising about 90% acetone, and 10% alcohol and other oxygenates. In particular, the solvent comprised 90 volume percent acetone and 7 volume percent methanol. Such a solvent is sold under the tradename "AQ-1" by the Steuber Company of Greenwich, Ct., the Material Safety Data Sheet of which is incorporated herein by reference. The cylinders were attached to the same acetylene filling manifold and filled with acetylene at the same time and under the same conditions as in comparative Example 1. On average, a 129.3 SCF of acetylene were dispensed to each container to bring the containers to the full state in compliance with CGCA Pamphlet C-12 guidelines.

On average, each cylinder had an acetylene capacity of about 0.55 pounds of acetylene per pound solvent. Moreover, no loss of solvent was noted upon withdrawal of the acetylene from the cylinders at a release rate of 25% of the total volume per hour.

What is claimed is:

1. A method for storing acetylene in containers of the type having a porous mass contained therein, said method comprising:

(a) adding a solvent to said container, said solvent comprising acetone and a lower alkyl alcohol, said lower alkyl alcohol being present in an amount sufficient to improve the acetylene storage capacity of the solvent; and (b) adding acetylene to said containers.

2. The method of claim 1 wherein said solvent comprises a mixture of acetone and an alcohol selected from the group consisting of methanol, ethanol, propanol, and mixtures of these.

3. The method of claim 2 wherein said solvent comprises a mixture of acetone and methanol.

4. The method of claim 1 wherein said solvent comprises about 90 volume percent acetone and up to about 10 volume percent methanol.

5. An improved container for storing acetylene, said container being of the type having a porous mass contained therein and a solvent occupying at least a portion of the porous space of said porous mass, the improvement comprising:

said solvent comprising acetone and a lower alkyl alcohol, said alcohol being present in an amount sufficient to improve the acetylene storage capacity of the solvent .

6. The improved container of claim 5 wherein said solvent comprises a mixture of acetone and an alcohol selected from the group consisting of methanol, ethanol, propanol, and mixtures of these.

7. The improved container of claim 6 wherein said solvent comprises a mixture of acetone and methanol.

8. The improved container of claim 7 wherein said solvent comprises about 90 volume percent acetone.

9. The improved container of claim 8 wherein said solvent comprises about 90% acetone and up to about 10% methanol.

10. The improved container of claim 6 wherein said solvent comprises more than trace amounts of said alcohols.

* * * * *